United States Patent [19]

Mazzorana

[11] 4,156,220

[45] May 22, 1979

[54] STARTER SOLENOID

[75] Inventor: Alfred B. Mazzorana, Venissieux, France

[73] Assignee: Societe de Paris et du Rhone, Lyons, France

[21] Appl. No.: 791,300

[22] Filed: Apr. 27, 1977

[30] Foreign Application Priority Data

May 11, 1976 [FR] France ..... 76 14865

[51] Int. Cl.[2] ..... H01F 7/16

[52] U.S. Cl. ..... 335/262; 335/255

[58] Field of Search ..... 335/255, 126, 262, 266, 335/256

[56] References Cited

U.S. PATENT DOCUMENTS

| | | | |
|---|---|---|---|
| 1,894,429 | 1/1933 | Starr | 335/262 |
| 2,582,351 | 1/1952 | Olson | 335/262 |
| 3,274,525 | 9/1966 | Valleau | 335/255 |
| 4,041,426 | 8/1977 | Zemanek et al. | 335/126 |

*Primary Examiner*—Harold Broome

*Attorney, Agent, or Firm*—Browdy and Neimark

[57] ABSTRACT

An improved starter solenoid for an internal combustion engine has magnetic yoke, designed to eliminate gaps in magnetic flux, which supports two switch windings for pulling and holding a movable core acting on the starter gear and on the movable switch contact. The yoke, in the form of a rectangular frame without gaps, has two short sides, one of which supports a fixed core to support the two switch windings, while the other contains an opening, coaxial with the fixed core, to allow passage of the movable core. A sleeve is fitted with one end on the fixed core and the other end inside the opening, and serves as a bearing for the movable core.

6 Claims, 6 Drawing Figures

STARTER SOLENOID

FIELD OF THE INVENTION

The present invention relates to a starter solenoid for an internal combustion engine, for example a motor vehicle engine and more particularly to a starter solenoid with two windings inside a magnetic yoke, provided respectively for pulling and holding a movable core acting on the starter gear and on the movable contact of the switch.

BACKGROUND OF THE INVENTION

The yokes of solenoids currently in use are generally in the form of a horseshoe whose central part supports either the fixed core supporting the two windings or an opening to allow passage of the movable core. The free ends of the side arms of the yoke are connected by a piece of ferromagnetic material, attached to them by crimping, and supporting, opposite the middle part, the opening to allow passage of the movable core or the fixed core.

Thus, this yoke has gaps at two points which are oriented transversely to the direction of the magnetic flux and which consequently block its passage.

SUMMARY OF THE INVENTION

The goal of the present invention is to overcome this disadvantage by eliminating the gaps in the magnetic flux.

In the present invention, the magnetic yoke has the shape of a rectangular frame made without a gap, one side supporting at its center, directed toward the opposite side and perpendicular to the latter, the fixed core designed to support the two switch windings, while the opposite side contains, coaxially to the fixed core, the opening designed to allow passage of the movable core.

Thus, this yoke does not have a gap in the direction of flow of the magnetic flux.

In order to allow the mounting of a rigid sleeve intended to serve as a bearing for the movable core, the diameter of the fixed core is smaller than that of the opening provided to allow passage of the movable core by a dimension which essentially corresponds to the thickness of the bearing, which therefore can be fitted with one end on the fixed core and on the other end inside the opening.

According to a first embodiment of this solenoid, in the case where the two windings are mounted on a single spool, the distance between the ends facing the fixed core and the opening to allow passage of the movable core is at least equal to the total length of the spool.

Thus, in order to install the single spool, it will suffice to insert it in the space provided axially with respect to the fixed core and to fit it on the latter before installing the bushing which is to serve as a bearing for the movable core.

In cases where the above distance between the free ends opposite the fixed core and the opening is less than the length of the spool, the body of the latter is made of two elements which are symmetrical relative to a diametral plane.

In this case, the elements must be wound after installing the spool body, for example by means of a drive pin fitted into the opening in the coil through the opening in the magnetic yoke, the sleeve serving as a bearing for the movable core not being installed until after the windings have been wound.

In another embodiment of the invention, allowing the installation of the coil after the windings have been wound, the magnetic yoke consists of two symmetrical elements assembled along a median plane by welding, gluing, or the like. It should be kept in mind that the gap thus produced between the two parts of the yoke is parallel to the direction of flow of the magnetic flux so that the flow of this flux is hardly disturbed at all.

According to still another embodiment of the invention, the two windings are wound on two independent spools, coaxial and located side by side, capable of being fitted successively into the yoke, the overall length of each spool being less than the distance separating the ends opposite the fixed core and the opening in the magnetic yoke, while the sleeve which serves as a bushing for the movable core can be installed after the above spool have themselves been installed.

The magnetic yoke of this solenoid, regardless of whether it is composed of one or two pieces, can be manufactured by casting, stamping, forging, calcination or the like, without additional machining except for that involving the threaded holes required for mounting the switch on the starter.

BRIEF DESCRIPTION OF THE DRAWINGS

In any case, the invention will be more clearly evident from the description which follows, showing as nonlimiting examples several embodiments of this yoke, described with reference to the drawings, in which.

DESCRIPTION OF THE PREFERRED EMBODIMENTS

Figure 1:
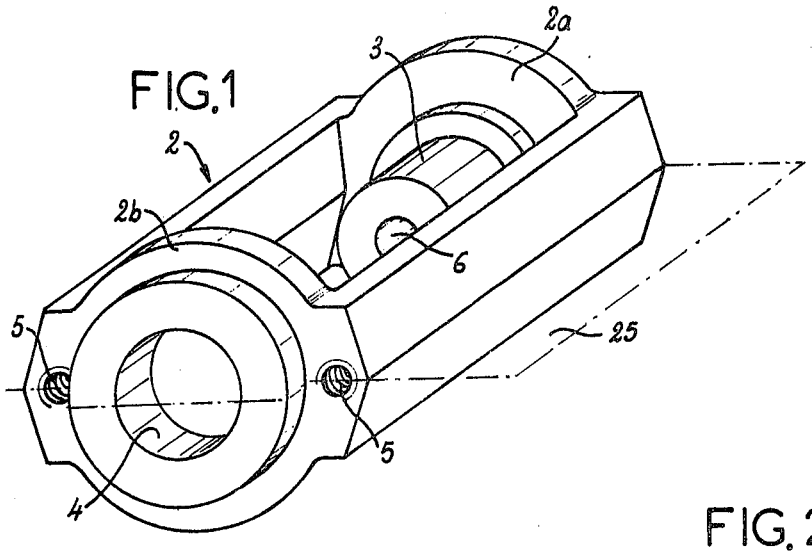
FIG. 1 is a perspective view of the yoke alone.

As FIG. 1 shows, the yoke according to the invention is in the shape of a rectangular frame 2 whose opposite short sides **2*a* and 2*b* support, respectively, fixed core 3 and opening 4 to allow passage of the movable core of the solenoid, not shown in FIG. 1**.

The yoke 2 can be made in one piece by stamping, casting, forging, calcination or the like. In this case, the only subsequent machining processes are the following:

(a) finishing the forward end of the magnetic circuit which serves as a mounting support, i.e. the end with the two threaded holes 5;

(b) opening 4;

(c) opening 6 through fixed core 3;

(d) finishing the forward end of core 3 which serves as a support for the movable core at the end of its travel.

Figure 2:
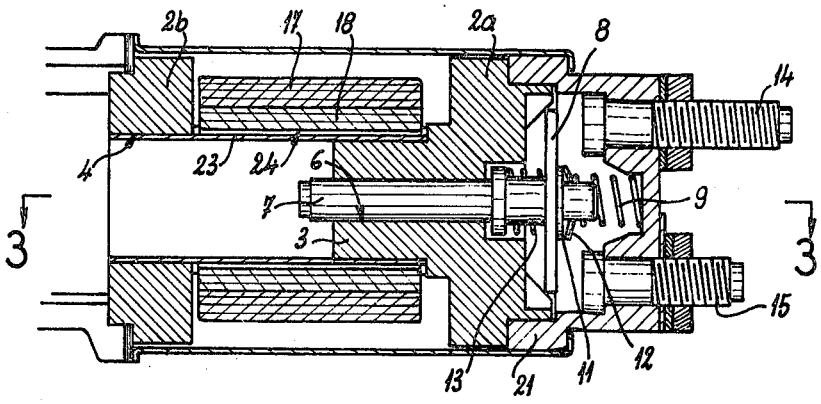
FIGS. 2 and 3 are views of the solenoid according to the invention in axial cross section along 2—2 in FIG. 3 and 3—3 in FIG. 2, respectively.
Figure 3:
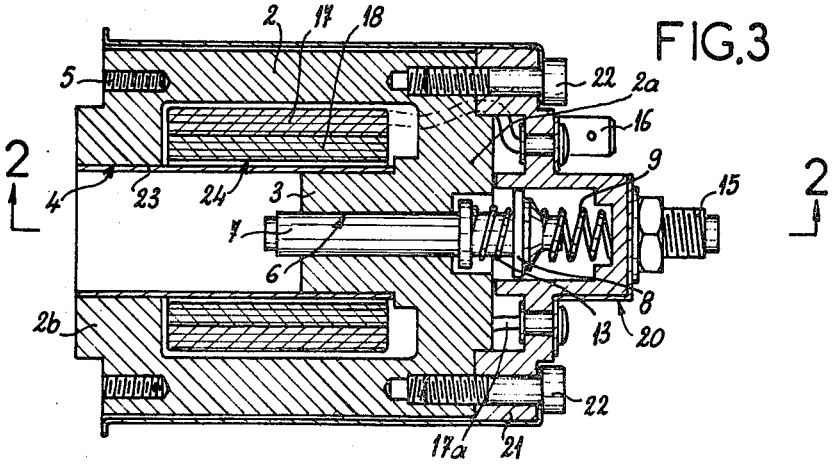

FIGS. 2 and 3 show in detail the electrical equipment of this solenoid, which is of a classical type and which comprises in addition to the elements listed above, a return spring 9 for movable contact 8, a retaining washer 11 for movable contact 8, a lock washer 12 for the movable contact 8, a compression spring 13 for the contact 8, two fixed terminals 14 and 15, a terminal 16 common to windings 17 and 18, and a link 20 between terminal 15 and lead 17*a* of pulling winding 17 such that this winding 17 is short-circuited when movable contact 8 establishes direct contact between fixed terminals 14 and 15.

All of the above electrical parts are supported by, and mounted in, a housing 21 made of insulating material mounted on the magnetic yoke by screws 22.

As can be seen from FIG. 2, the mounting provided to hold and guide the movable core is delimited by a cylindrical sleeve 23 whose thickness corresponds to the difference in diameter between fixed core 3 and opening 4 in magnetic yoke 2. Sleeve 23, which serves as a bearing for the movable core, is thus engaged at one end with fixed core 3 and at the other end with opening 4.

In the embodiment shown in FIG. 2, the two windings 17 and 18 are superimposed on a single spool 24, the latter itself being fitted on bearing 23.

When the length of spool 24 is less than the distance separating the ends opposite the fixed core 3 and opening 4, it is possible to insert the spool 24 in the space separating these ends and to move it axially on core 3 and then install bearing 23. However, in the case where the above distance is less than the length of the spool body 24, this method of assembly is impossible and it is then necessary for spool body 24 to be made in a number of parts in order to be installed before winding inside yoke 2, with the two windings 17 and 18 then being wound by means of a pin fitted into the opening of spool body 24, through opening 4, and before installing bearing 23.

For example, the spool body 24 can be composed of two elements symmetrical along an axial plane, thus forming, so to speak, two cylindrical shells which can easily be fitted around core 3.

Figure 4:
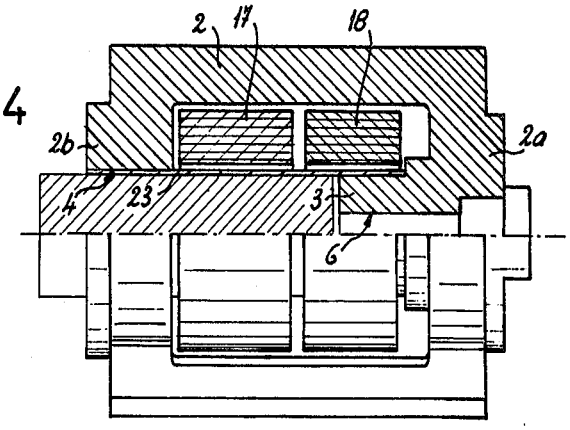
FIG. 4 is a side elevation with an axial half-section similar to FIG. 2, showing a different design for this yoke.

FIG. 4 shows another embodiment of this switch, in which the two windings 17 and 18 are wound on two independent spools with the same diameter and mounted side by side coaxially. It is apparent that the length of a single spool is less than the distance separating the ends opposite the fixed core and the opening in the magnetic armature, and their installation in the interior of the latter poses no difficulty.

Figure 5:
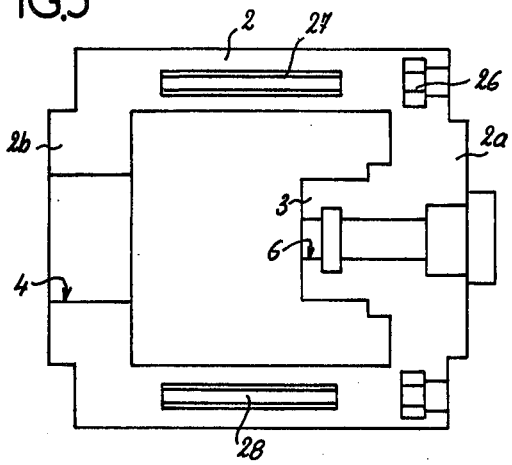
FIG. 5 is a plan view, from above, of an element of this yoke composed of two symmetrical elements along a diametral plane.
Figure 6:
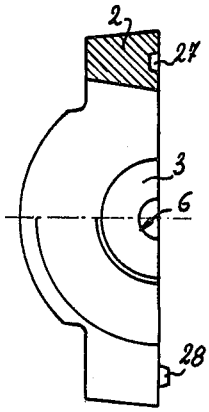
FIG. 6 is an end view of the element in FIG. 5 with a transverse half-section.

According to the embodiment of the solenoid illustrated in FIGS. 5 and 6, magnetic yoke 2 is composed of two separate elements assembled along a diametrical plane shown by dot-dash lines in FIG. 1 and designated by reference number 25. This plane of assembly of the two elements of yoke 2 being parallel to the direction of the magnetic flux, it does not cause any perturbation of the circulation of this flux.

In this embodiment, the only additional finishing steps required for the yoke consist in making the threaded holes 5 which serve for mounting the switch of the starter, because opening 6 of the fixed core can be provided before assembly in the same way as recesses 26 for the heads of bolts 22 designed to mount casing by means of two fitted nuts (assembly is the reverse of that shown in FIG. 3).

In order to allow correct positioning of the two symmetrical parts of yoke 2, each of the long sides is provided in its plane of connection with a semicylindrical recess 27, for example coaxial to opening 6, allowing the installation of a centering pin, not shown in the drawing.

The assembly of the two parts of yoke 2 can be accomplished in any appropriate fashion. It is particularly advantageous to join the two parts by welding. For this purpose, each long side of the yoke is provided on the face which is in contact with the plane of assembly with a projection 28 and a recess 27 of corresponding dimensions, each projection of one of the elements being capable of being contact-welded into the recesses in the associated element.

As clearly emerges from the foregoing, the invention is not limited to only those embodiments of the solenoid which have been described hereinabove as nonlimitative examples; on the contrary, it includes all variations of the design encompassed within the scope of the claims.

What is claimed is:

1. A starter solenoid for actuating a motor in an internal combustion engine comprising:

a magnetic yoke in the shape of a continuous rectangular frame, having two long sides, and first and second short sides substantially shorter than the two long sides, said first short side having a circular opening extending axially therethrough:

a fixed cylindrical core, inside said magnetic yoke, attached to said second short side of said magnetic yoke, said fixed core being coaxial with respect to the opening in said first short side of said magnetic yoke;

two windings, inside said magnetic yoke, supported by said fixed core;

a movable cylindrical core, slidingly engaging the opening in said first short side of said magnetic yoke, along the longitudinal axis thereof, said two windings, respectively, attracting and holding said movable core.

2. A starter solenoid, according to claim 1 further including:

bearing means for supporting said movable core, one end of which is connected to said fixed core, the other end of which is connected to said magnetic yoke inside the opening in said first short side, the diameter of said fixed core being smaller than the diameter of said opening in one side of said magnetic yoke by an amount which essentially corresponds to the thickness of said bearing means.

3. A starter solenoid, according to claim 1, further including a single spool body, on which said two windings are mounted inside said magnetic yoke, the distance from said fixed core to the opening in said first short side of said magnetic yoke being at least equal to the length of said spool body.

4. A starter solenoid, according to claim 1, further including a single spool body, on which said two windings are mounted inside said magnetic yoke, the distance from said fixed core to said opening in a short side of said magnetic yoke being less than the length of said spool body, said spool body comprising two elements symmetrical relative to a diametrical plane.

5. A starter solenoid, according to claim 1, wherein said magnetic yoke comprises two symmetrical elements attached to one another along a median plane.

6. A starter solenoid, according to claim 2, further including two axially spaced spools, each winding being wrapped around one of said independent spools, said spools being coaxial and mounted side by side on said bearing means, the length of both of said spools, added together, being less than the distance between said fixed core and the opening in said first short side of said magnetic yoke.

* * * * *